US007921493B2

(12) United States Patent
Kim et al.

(10) Patent No.: US 7,921,493 B2
(45) Date of Patent: Apr. 12, 2011

(54) WASHING MACHINE

(75) Inventors: Kyeong Hwan Kim, Seoul (KR); Il Hyeon Jo, Seoul (KR); Jin Ho Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 322 days.

(21) Appl. No.: 12/057,810

(22) Filed: Mar. 28, 2008

(65) Prior Publication Data

US 2008/0235880 A1 Oct. 2, 2008

(30) Foreign Application Priority Data

Mar. 31, 2007 (KR) ..... 10-2007-0032082

(51) Int. Cl.
*D06F 39/02* (2006.01)

(52) U.S. Cl. ..... 8/158; 68/17 R; 68/207

(58) Field of Classification Search ..... 68/17 R, 68/207

See application file for complete search history.

(56) References Cited

U.S. PATENT DOCUMENTS 3,567,076 A * 3/1971 Zanussi ..... 222/144
5,195,338 A * 3/1993 Russo ..... 68/12.18
5,791,168 A * 8/1998 Smock et al. ..... 68/12.18
5,848,610 A * 12/1998 Livernash et al. ..... 137/625.11
5,862,749 A * 1/1999 Lizarazu ..... 101/3.1
6,035,472 A * 3/2000 Barbe ..... 8/158
7,210,315 B2 * 5/2007 Castelli et al. ..... 68/12.18
7,658,088 B2 * 2/2010 Walker et al. ..... 68/17 R
2006/0091754 A1 5/2006 Kim et al.
2006/0117811 A1 * 6/2006 Kinnetz ..... 68/17 R
2006/0150687 A1 7/2006 Chang et al.
2006/0179584 A1 8/2006 Choi et al.
2006/0191301 A1 8/2006 Park et al.
2007/0214630 A1 9/2007 Kim

FOREIGN PATENT DOCUMENTS

FR 2 588 292 * 4/1987

OTHER PUBLICATIONS

European Patent Office 0 077 463 Apr. 1983.*
European Patent Office 1 029 965 Aug. 2000.*
U.S. Appl. No. 12/051,158 to Kim et al, filed Mar. 19, 2008.

* cited by examiner

*Primary Examiner* — Frankie L Stinson
(74) *Attorney, Agent, or Firm* — Birch, Stewart, Kolasch & Birch, LLP

(57) ABSTRACT

Disclosed is a washing machine, which can automatically supply a liquid detergent into a washing tub and automatically clean inner flow passages through which the liquid detergent has flown with a cleaning solution. A liquid detergent supply mechanism supplies at least one kind of liquid detergent to the washing tub, and the inner flow passages of the liquid detergent supply mechanism through which the liquid detergent has flown are cleaned with the cleaning solution supplied from outside.

11 Claims, 10 Drawing Sheets

WASHING MACHINE

This Nonprovisional application claims priority under 35 U.S.C. 119(a) on Patent Application No. 10-2007-0032082 filed in Korea on Mar. 31, 2007, the entire contents of which are hereby incorporated by reference.

BACKGROUND OF THE INVENTION

1. Field of the Invention

The present invention relates to a washing machine, and more particularly, to a washing machine, which can automatically supply a liquid detergent into a washing tub and automatically wash out residual liquid detergent.

2. Discussion of the Related Art

Generally, a washing machine is an apparatus for cleaning laundry via washing, rinsing, and dewatering in order to separate dirt from clothes, bedding and so on (hereinafter, referred to as 'laundry') using water, detergent and a mechanical operation.

In a washing machine according to the conventional art, a user has to put detergent directly in a detergent box, and thus the user has to repeat putting in the detergent whenever washing laundry, which deteriorates the use convenience of the washing machine. Moreover, it is difficult to expect consumers to properly determine the amount of detergent to be put in to a detergent box. Hence, they put too much detergent in, thereby wasting the detergent, or they put too little detergent in, thereby deteriorating washing performance.

SUMMARY OF THE INVENTION

It is an object of the present invention to provide a washing machine, which improves user convenience by automatically supplying liquid detergent in to a washing tube, and prevents a flow passage from clogged due to the solidification of the liquid detergent by automatically cleaning the flow passage through which the liquid detergent flows upon completion of supply of the liquid detergent.

It is another object of the present invention to provide a washing machine, which prevents detergent from being wasted by excessive supply of detergent and prevents washing performance from being deteriorated by insufficient supply of detergent by accurately controlling the amount of detergent to be supplied to a washing tub.

To achieve the foregoing objects, there is provided a washing machine according to the present invention, which comprises: a washing tub; and a liquid detergent supply mechanism, wherein the liquid detergent supply mechanism comprises at least one liquid detergent storage part for storing liquid detergent to be supplied to the washing tub, and supplies the liquid detergent stored in the liquid detergent storage part to the washing tub and then removes residual liquid detergent not supplied to the washing tube by using a cleaning solution.

The liquid detergent supply mechanism may further comprise: a valve; a cleaning solution storage part for storing the cleaning solution; a cleaning solution supply passage connecting the valve and the cleaning solution storage part; first flow passages connecting the valve and the at least one liquid detergent storage part, respectively; and a second flow passage communicated or blocked to the first flow passages or the cleaning solution supply passage by the valve, and guiding the liquid detergent or the cleaning solution to the washing tub.

The liquid detergent supply mechanism may comprise: a valve; a cleaning solution supply part including a cleaning solution supply passage to guide the cleaning solution, and allowing the cleaning solution to be supplied to the valve via the cleaning solution supply passage; first flow passages connecting the valve and the at least one liquid detergent storage part, respectively; and a second flow passage communicated or blocked to the first flow passages or the cleaning solution supply passage by the valve, and guiding the liquid detergent or the cleaning solution to the washing tub. The cleaning solution includes a washing water supplied from an external water source of the washing machine, and the cleaning solution may be supplied to the valve by the pressure of the external water source that allows the washing water to be supplied to the washing machine, thus washing out residual detergent.

The washing machine further comprises a circulation mechanism for circulating the washing water stored in the washing tub, the cleaning solution includes the washing water, and the liquid detergent supply mechanism may further comprise: a valve; a cleaning solution supply passage connecting the valve and the circulation mechanism; first flow passages connecting the valve and the at least one liquid detergent storage part, respectively; and a second flow passage communicated or blocked to the first flow passages or the cleaning solution supply passage by the valve, and guiding the liquid detergent or the cleaning solution to the washing tub. The circulation mechanism may further comprise a circulation pump generating a pressure differential so as to circulate the water in the washing tub, and when the cleaning solution supply passage and the second flow passage are communicated with each other by the valve, the cleaning solution may be introduced into the washing tub via the second flow passage according to the pressure differential induced by the circulation pump, thereby removing residual detergent.

The washing machine further comprises a draining mechanism for discharging out the washing water stored in the washing tub, the cleaning solution includes the washing water drained by the draining mechanism, and the liquid detergent supply mechanism may further comprise: a valve; a cleaning solution supply passage connecting the valve and the circulation mechanism; first flow passages connecting the valve and the at least one liquid detergent storage part, respectively; and a second flow passage communicated or blocked to the first flow passages or the cleaning solution supply passage by the valve, and guiding the liquid detergent or the cleaning solution to the washing tub. The draining mechanism further comprises a drainage pump generating a pressure differential so as to discharge out the washing water being drained, and when the cleaning solution supply passage and the second flow passage are communicated with each other by the valve, the washing water being drained may be introduced into the washing tub via the second flow passage according to the pressure differential induced by the drainage pump, thereby removing residual detergent.

The washing machine further comprises a detergent supply pump generating a pressure so as to induce the liquid detergent or the cleaning solution to the washing tub, wherein the pressure operating on the cleaning solution to wash out residual liquid detergent not supplied to the washing tub may be introduced from the detergent supply pump.

In another aspect, there is provided a washing machine according to the present invention, which comprises: a washing tub; and a liquid detergent supply mechanism, wherein the liquid detergent supply mechanism comprises: at least one liquid detergent storage part for storing liquid detergent supplied to the washing tub; a valve; first flow passages connecting the valve and the liquid detergent storage part so as to introduce the liquid detergent stored in the liquid detergent storage part to the valve; and a cleaning solution supply passage for guiding the cleaning solution so that the cleaning solution for removing residual liquid detergent not supplied to the washing tub can reach the valve. Check valves for preventing backflow of the liquid detergent may be disposed on the first flow passages, respectively.

The liquid detergent supply mechanism provided in the washing machine may further comprise a second flow passage connecting the valve and the washing tube so that the liquid detergent or cleaning solution passing through the valve can be introduced into the washing tub.

The liquid detergent storage part may be provided in plural, the first flow passages are provided in plural corresponding to the plurality of liquid detergent storage parts, and the valve may perform the function of selectively communicating at least one of the first flow passages and the cleaning solution supply passage to the second flow passage. One side of the second flow passage may be directly connected to the washing tub.

The washing machine further comprises a detergent supply mechanism disposed on a water supply passage for supplying water to the washing tub to supply detergent to the washing tub, and one side of the second flow passage may be connected to the detergent supply mechanism.

The liquid detergent supply mechanism provided in the washing machine may further comprise a detergent supply pump disposed on the second flow passage to induce a pressure differential so as to supply the liquid detergent to the washing tub. The detergent supply pump is operated in a forward direction for a first set period of time so that the liquid detergent in the liquid detergent storage part can be supplied to the washing tub via the first flow passages, the valve, and the second flow passage, the detergent supply pump is stopped to operate or operates in a backward direction for a second set period of time so that the liquid detergent left in at least one of the first flow passages, the valve, and the second flow passage can be recovered to the liquid detergent storage part, and the detergent supply pump re-operates in a forward direction for a third set period of time so that the liquid detergent left in at least one of the first flow passages, the valve, and the second flow passage can be removed by making the cleaning solution flow to the washing tub.

In still another aspect, there is provided a washing method of a washing machine according to the present invention, the washing machine comprising: a washing tub; and a liquid detergent supply mechanism, wherein the liquid detergent supply mechanism comprises: at least one liquid detergent storage part for storing liquid detergent supplied to the washing tub; a valve; first flow passages connecting the valve and the liquid detergent storage part so as to introduce the liquid detergent stored in the liquid detergent storage part to the valve; a cleaning solution supply passage for guiding the cleaning solution so that the cleaning solution for removing residual liquid detergent not supplied to the washing tub can reach the valve; a second flow passage connecting the valve and the washing tub so that the liquid detergent or cleaning solution passing through the valve can be introduced into the washing tub; and a detergent supply pump disposed on the second flow passage to induce a pressure differential so as to supply the liquid detergent to the washing tub, the method comprising: a liquid detergent supply step in which the detergent supply pump operates in a forward direction so that the liquid detergent in the liquid detergent storage part can be supplied to the washing tub via the first flow passages, the valve, and the second flow passage; a liquid detergent recovery step in which the detergent supply pump is stopped to operate or operates in a backward direction for a second set period of time so that the liquid detergent left in at least one of the first flow passages, the valve, and the second flow passage can be recovered to the liquid detergent storage part; and a liquid detergent washout step in which the detergent supply pump re-operates in a forward direction for a third set period of time so that the liquid detergent left in at least one of the first flow passages, the valve, and the second flow passage can be removed by making the cleaning solution flow to the washing tub.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Hereinafter, embodiments of the present invention will be described with reference to the accompanying drawings.

Figure 1:
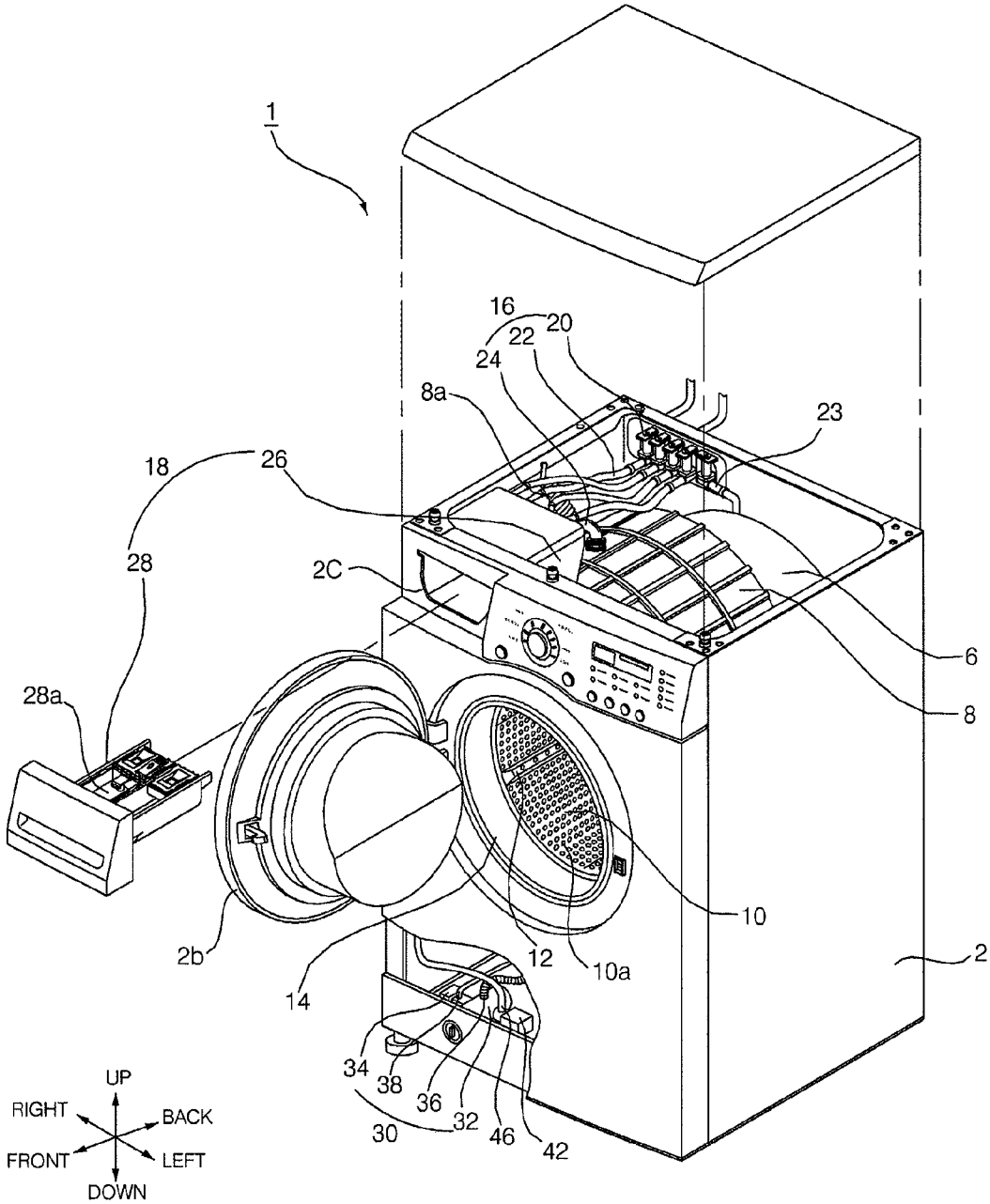
FIG. 1 is a perspective view showing a drum type washing machine according to a first embodiment of the present invention.
Figure 2:
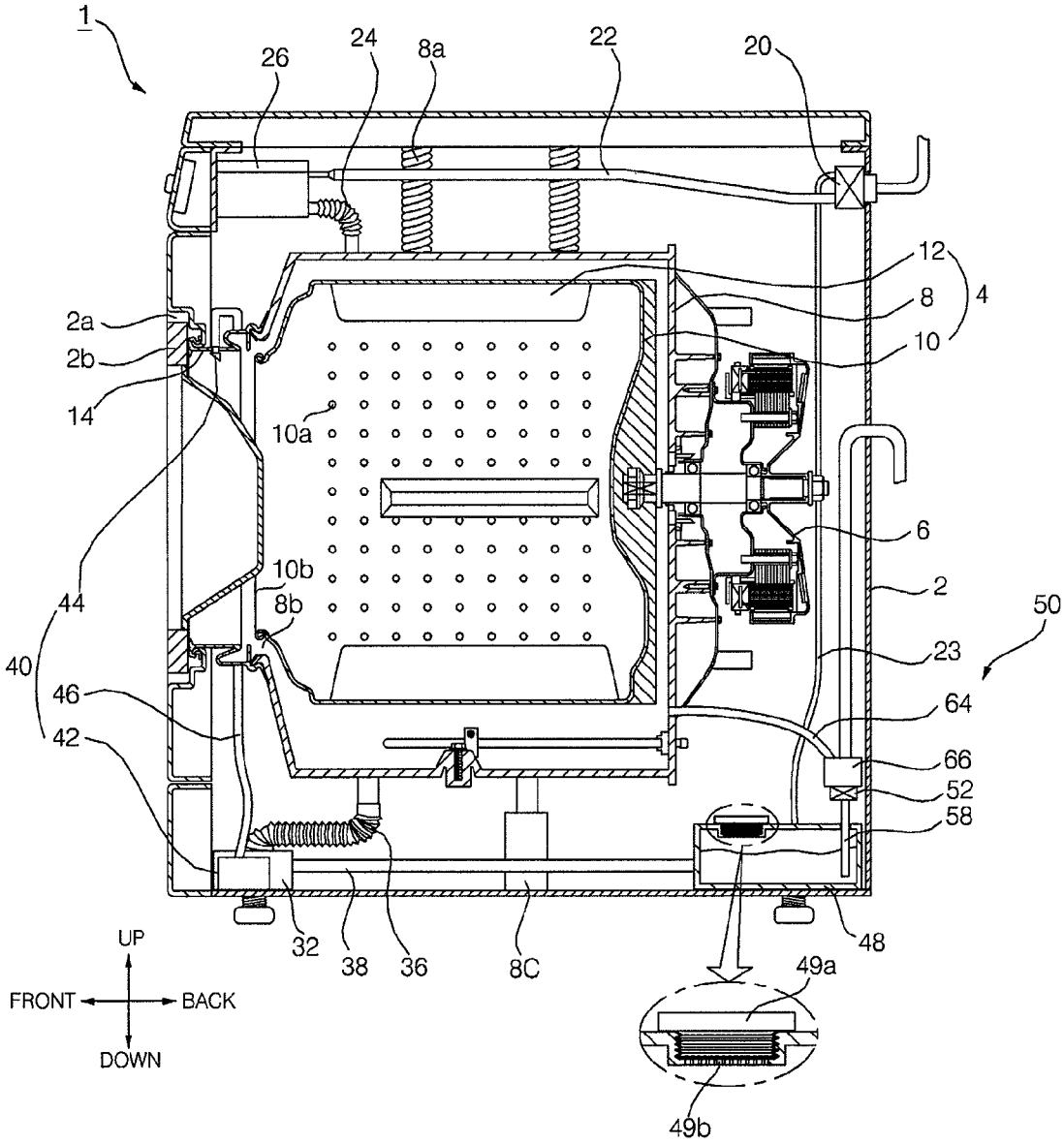
FIG. 2 is a side cross sectional view of a drum type washing machine as shown in FIG. 1.
Figure 3:
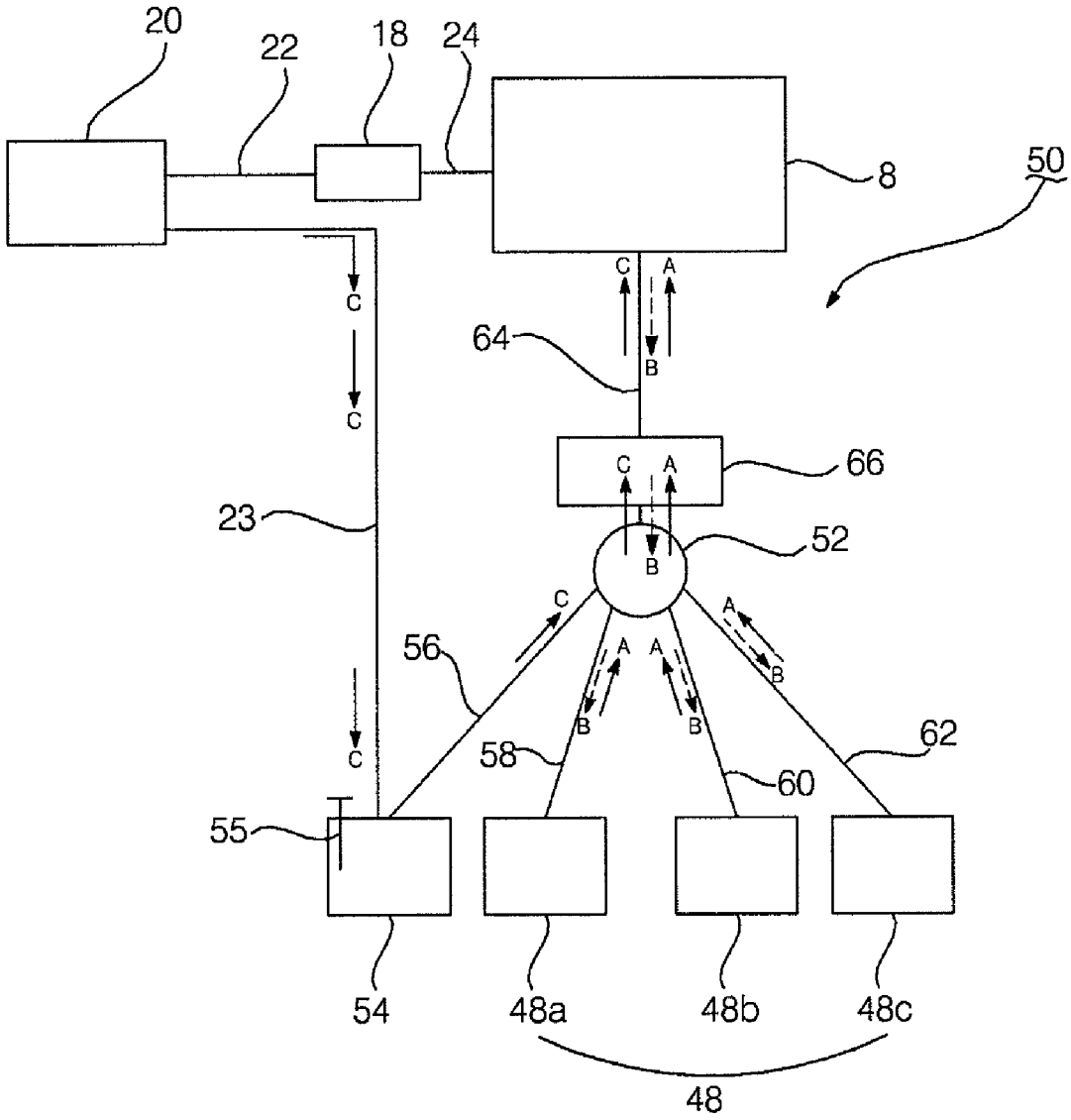
FIG. 3 is a block diagram schematically showing essential parts of the drum type washing machine as shown in FIG. 1.
Figure 4:
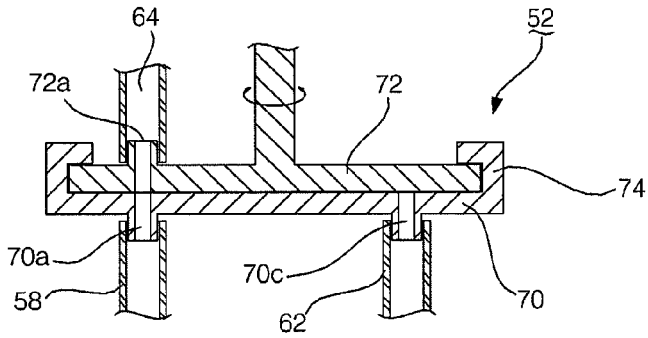
FIG. 4 is a side cross sectional view showing one example of a valve as shown in FIG. 3.
Figure 5:
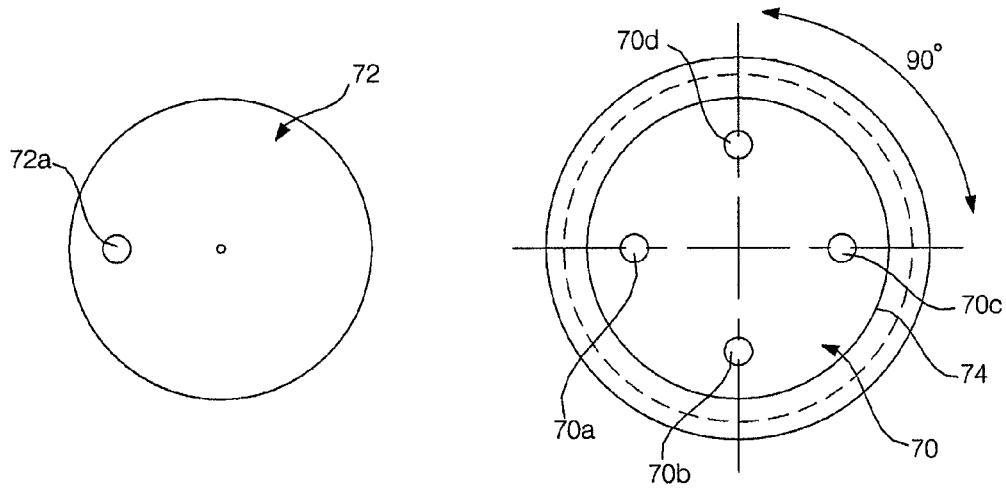
FIG. 5 is a bottom view and a plane view showing a stationary part and a rotating part of the valve as shown in FIG. 4.

FIG. 1 is a perspective view showing a drum type washing machine according to a first embodiment of the present invention. FIG. 2 is a side cross sectional view of a drum type washing machine as shown in FIG. 1. FIG. 3 is a block diagram schematically showing essential parts of the drum type washing machine as shown in FIG. 1. FIG. 4 is a side cross sectional view showing one example of a valve as shown in FIG. 3. FIG. 5 is a bottom view and a plane view showing a stationary part and a rotating part of the valve as shown in FIG. 4.

Although only a drum type washing machine has been illustrated in the drawings, the scope of this invention is not limited by the type of a washing machine. That is, the present invention may be applied to various washing machines, such as a water jet washing machine using the rotation of a pulsator or a tower type washing machine in which laundry is put in from above. Accordingly, the following description is only a description of an example in which the present invention is applied to a drum type washing machine among washing machines.

Hereinafter, a washing machine according to a first embodiment of the present invention will be described with reference to FIGS. 1 to 6.

Referring to FIGS. 1 and 2, the washing machine comprises a casing 2 forming the outer appearance thereof, a washing tub 4 rotatably disposed in the casing 2 to contain laundry, detergent and water, and a driving mechanism 6 connected to the washing tub 4 to drive the washing tub 4.

The washing tub 4 comprises a tub 8 disposed in the casing 2 so as to be buffered by springs 8*a* and a damper 8*c* and containing water and detergent therein, a drum 10 rotatably disposed in the tub 8 to contain laundry therein and provided with a plurality of water holes 10*a* through which the water and detergent in the tub 8 pass, and a lifter 12 disposed on the inner surface of the drum 10 to lift laundry to a predetermined height upon rotation of the drum 10 and then drop it.

Opening parts 8*b* and 10*b* through which the laundry is put in and out are formed on the front surface of the drum 10. A laundry entrance 2*a* for putting laundry in and out is formed at a position opposite to the opening parts 8*b* and 10*b* on the front surface of the casing 2. A door 2*b* for opening and closing the laundry entrance 2*a* is rotatably disposed on the casing 2. A gasket 14 serving as a packing is disposed between the opening part 8*b* of the tub 8 and the laundry entrance 2*a* so as to damp impact caused by the rotation of the drum 10 and keep water from overflowing.

Referring to FIGS. 1 and 2, the drum type washing machine 1 further comprises a water supply mechanism 16 disposed on the upper side of the tub 8 to supply water from outside to the tub 8 and a detergent supply mechanism 18 disposed on a water supply passage of the water supply mechanism 16 to supply detergent required for washing to the tub 8.

The water supply mechanism 16 comprises a plurality of water supply valves 20 disposed on the casing 2 and connected to an external water source and a water supply passage formed between the water supply valves 20 and the tub 8 to guide water to the tub 8. The water supply passage comprises a plurality of first water supply hoses 22 connecting the water supply valves 20 and the detergent supply mechanism 18, respectively, and a second water supply hose 24 connecting the water supply mechanism 18 and the tub 8.

The detergent supply mechanism 18 is an apparatus, into which a user puts detergent in before the operation of the drum type washing machine 1, and which supplies the detergent to the tub 8 upon operation of the drum type washing machine 1. The detergent supply mechanism 18 comprises a dispenser 26 connected to the first water supply hoses 22 at an upper portion and connected to the second water supply hose 24 at a lower portion and a detergent box 28 with a plurality of detergent containing parts 28*a* accommodated in the dispenser 26 so as to be drawn in and out and allowing a user to put detergent in. The dispenser 26 is opened at the front surface and communicatively coupled to a hole part 2*c* formed on the front surface of the casing 2. The detergent box 28 is disposed so as to be put in and out of, the dispenser 26 through the hole part 2*c* of the casing 2. Accordingly, the dispenser 26 receives water from the first water supply hoses 22 and selectively dispenses water into the detergent containing parts 28*a*, and supplies the water discharged along with the detergent from the detergent containing parts 28*a* of the detergent box 28 to the tub 8 through the second water supply hose 24. The detergent to be put in to the detergent supply mechanism 18 may include both powder detergent and liquid detergent.

Referring to FIGS. 1 and 2, the drum type washing machine 1 further comprises a draining mechanism 39 disposed on the lower side of the tub 8 to drain out the water and detergent in the tub 8. The draining mechanism 30 comprises a drainage passage for guiding the water in the tub 8 to outside the casing 2, a drainage filter 32 disposed on the drainage passage to remove impurities contained in the water being drained out, and a drainage pump 34 disposed on one side of the drainage filter 32 and forming a pressure differential so that, water flows along the drainage passage. The drainage passage comprises a first drainage hose 36 connecting the bottom portion of the tub 8 and the drainage filter 32, and a second drainage hose 38, one end of which is connected to the drainage filter 32, and the other end of which is disposed on the outer side of the casing 2.

Referring to FIGS. 1 and 2, the washing machine 1 further comprises a circulation mechanism 40 disposed on one side of the tub 8 and for circulating the water stored in the tub 8. The circulation mechanism 40 comprises a circulation passage, both opposite ends of which are communicatively connected to the tub 8 at a different height, a circulation pump 42 disposed on the circulation passage and for circulating the water in the tub 8 along the circulation passage, and a circulation nozzle 44 disposed on one end from which water is discharged among both opposite ends of the circulation passage and for dispensing water into the tub 8. Hence, the laundry in the drum 10 is uniformly wet within a short time by the circulation mechanism 40.

The circulation pump 42 operates when water is stored in the tub 8 at a predetermined or higher water level to form a pressures differential so that the water in the tub 8 is forced to circulate from the other end to one end of the circulation passage. The circulation nozzle 44 is disposed to penetrate through the top portion of the gasket 14 and dispenses the water delivered via the circulation passage to the inside of the opening part 10*b* of the drum 10.

Although the circulation passage may be formed separately from the drainage passage, this embodiment uses some of the components of the draining mechanism 30 for common use in order to reduce the number of parts and simplify the structure thereof. That is, the circulation pump 42 is disposed on the other side of the drainage filter 32 to which the drainage pump 34 is not mounted, thereby using the first drainage hose 36 and the drainage filter 32 as part of the circulation passage. The circulation passage further comprises a circulation hose 46, one end of which is connected to the circulation nozzle 44, and the other end of which is connected to the circulation pump 42.

Referring to FIGS. 2 and 3, a liquid detergent supply mechanism 50 provided in the washing machine 1 will be described with reference to FIGS. 2 and 3.

The liquid detergent supply mechanism 50 is provided with at least one liquid detergent storage part 48 for storing at least one kind of liquid detergent supplied to the tub 8, respectively. The liquid detergent supply mechanism 50 performs the function of supplying the liquid detergent stored in the liquid detergent storage part 48 to the washing tub 4 and then removing residual liquid detergent not supplied to the washing tub by using a cleaning solution. Hereinafter, the liquid detergent supply mechanism 50 of this embodiment for performing the same function will be described more concretely.

The liquid detergent supply mechanism 50 comprises a valve 50, a cleaning solution storage part 54 for storing a cleaning solution, a cleaning solution supply passage 56 connecting the valve 52 and the cleaning solution storage part 54, a plurality of first flow passages 58, 60, 62 connecting the valve 52 and the liquid detergent storage part 48, respectively, a second flow passage 64 communicated or blocked to the cleaning solution storage part 54, and a detergent supply pump 66 disposed on the second flow passage 64 and forming a pressure differential so as to make the liquid detergent and the cleaning solution flow.

The liquid detergent storage part 48 may be provided in singular or plural in the washing machine 1 according to the type of liquid detergent used in the washing of laundry. Hereinafter, this embodiment will be described with respect to a case wherein a plurality of liquid detergent storage parts 48 are disposed on the drum type washing machine 1 to use various kinds of liquid detergents in the washing of laundry. In other words, the liquid detergent storage parts 48 may comprise a first liquid detergent storage part 48*a* for storing a laundry detergent of a liquid phase to remove dirt from the laundry, a second liquid detergent storage part 48*b* for storing a bleaching agent of a liquid phase to bleach the laundry, and a third liquid detergent storage part 48*c* for storing a softener of a liquid phase to soften the fabrics of the laundry.

Furthermore, it is preferred that the liquid detergent storage parts 48 are disposed in the casing 2 and positioned below the tub 8. However, their position is not limited thereto but at least one of the liquid detergent storage parts 48 may be positioned above the tub 8 or on the outer side of the casing 2.

The liquid detergent storage parts 48 disposed on the outer side of the casing 2 may be housed in a separate structure, such as a pedestal supporting the drum type washing machine 1. Referring to FIG. 2, a slot for putting in a liquid detergent is formed on the top portions of the liquid detergent storage parts 48, and a stopper 49*a* may be detachably mounted to the slot so as to prevent the liquid detergent in the liquid detergent storage parts 48 from hardening. Besides, a mesh type filter 49*b* may be disposed on the inner side of the slot so as to prevent impurities from entering into the liquid detergent storage parts 48.

In the liquid detergent supply mechanism 50, it is controlled by a controller (not shown), which is called a microcomputer, such that an appropriate amount of liquid detergent can be supplied according to the volume of laundry put into the drum 10. Further, it is controlled by the controller (not shown) such that a proper liquid detergent among the plurality of liquid detergents is supplied according to each washing stroke for laundry. Accordingly, as a liquid detergent is automatically supplied to the tub 8 by the liquid detergent supply mechanism 50, the supply of detergent by the detergent supply mechanism 18 and the water supply mechanism 16 may be omitted. When the supply of liquid detergent by the liquid detergent supply mechanism 50 is finished, at least part of the inner flow passage of the liquid detergent supply mechanism through which the liquid detergent has flown is cleaned with a cleaning solution supplied from outside.

The valve 52 is a direction control valve having a plurality of inlets corresponding the first flow passages 58, 60, and 62 and the cleaning solution supply passage 56 and one outlet corresponding to the second flow passage 64. The valve 52 allows at least one of the first flow passages 58, 60, and 62 and the cleaning solution supply passage 56 to be selectively communicated to the second flow passage 64.

FIG. 4 illustrates a four-direction control valve as one example of the valve 52. Referring to FIG. 4, the valve 52 comprises a stationary part having first, second, third, and fourth inlets 70*a*, 70*b*, 70*c*, and 70*d* connecting the first flow passages 58, 60, and 62 and the cleaning solution supply passage 56 and a rotary part 72 having one outlet 72*a* rotatably placed on the upper surface of the stationary part 70, and communicated to any one of the first, second, third, and fourth inlets 70*a*, 70*b*, 70*c*, and 70*d* depending on the angle of rotation by connecting to the second flow passage 64. A guide part 74 may be formed at the ends of the stationary part 70 in such a structure as to cover the ends of the rotary part 72. The guide part 74 rotatably supports the rotary part 72 and prevents leakage of the liquid detergent and the cleaning solution. Furthermore, FIG. 5 illustrates a plane view of the stationary part 70 and a bottom view of the rotary part 72. The first, second, third, and fourth inlets 70*a*, 70*b*, 70*c*, and 70*d* are formed on the stationary part 70 so as to be spaced apart from each other at the same angle along a circumferential direction. The outlet 72*a* is formed at a position corresponding to the first, second, third, and fourth inlets 70*a*, 70*b*, 70*c*, and 70*d*. Hence, whenever the rotary part 72 rotates at 90 degrees, the outlet 72*a* is selectively communicated to any one of the first, second, third, and fourth inlets 70*a*, 70*b*, 70*c*, and 70*d*.

Referring to FIGS. 1, 2, and 3, the cleaning solution storage part 54 will be explained. The cleaning solution storage part 54 is disposed on the inner side of the casing 2, and stores a cleaning solution therein. A water level sensor 55 for sensing the water level of the cleaning solution is disposed at the cleaning solution storage part 54. The cleaning solution storage part 54 may be connected to the water supply valves 20 by a third water supply hose 23. Thus, water used as the cleaning solution is automatically supplied into the cleaning solution storage part 54 by the water supply valves 20 and the third water supply hose 23. However, the cleaning solution storage part 54 may be disposed separately on the outer side of the casing 2, like the cleaning solution storage parts 48 are. Moreover, the cleaning solution storage part 54 may be provided with a slot (not shown) for allowing a user to directly put in the cleaning solution.

Referring to FIGS. 3, 4, and 5, the cleaning solution supply passage 56, the first flow passages 58, 60, and 62, and the second flow passage 64 will be explained. One end of the cleaning solution supply passage 56 is connected to the cleaning solution storage part 54, and the other end thereof is connected to the first inlet 70*a* of the valve 52. One ends of the first flow passages 58, 60, 62 are connected corresponding to the liquid detergent storage parts 48, and the other ends thereof are connected corresponding to the second, third, and fourth inlets 70*b*, 70*c*, and 70*d* of the valve 52. One end of the second flow passage 64 is connected to the outlet 72*a* of the valve 52, and the other end thereof is communicatively connected to the tub 8. That is, the other end of the second flow passage 64 is directly connected to the tub 8 to guide liquid detergent or cleaning solution into the tub 8. The liquid detergent or cleaning solution supplied to the tub 8 by the second flow passage 64 is mixed with water supplied into the tub 8. Alternatively, the other end of the second flow passage 64 may be communicatively connected to the dispenser 26 of the detergent supply mechanism 18. In this case, the liquid detergent or cleaning solution is dissolved in water supplied to the dispenser 26, and thus supplied into the tub 8 along the second water supply hose 24.

Referring to FIG. 3, the supply of the liquid detergent and the removal of residual detergent on the flow passages will be explained. The detergent supply pump 66 pumps a liquid detergent or a cleaning solution from the liquid detergent storage parts 48 and the detergent supply pump 66 disposed below the tub 8 to automatically supply an appropriate amount of liquid detergent or cleaning solution to the tub 8. The supply amount of the liquid detergent and the cleaning solution is controlled according to the operating rpm or operation time of the detergent supply pump 66, or controlled by an appropriate combination thereof.

Hereinafter, one of the methods in which the operating RPM of the detergent supply pump 66 is constant and the supply amount of the liquid detergent and the cleaning solution is controlled according to the operation time of the detergent supply pump 66.

If any one of the first flow passages 58, 60, and 62 is connected to the second flow passage 64, the detergent supply pump 66 operates in a forward direction for a first set period of time so as to supply liquid detergent to the tub 8 until a set amount is reached. When the supply of the liquid detergent is finished, the detergent supply pump 66 is stopped to operate or operates in a backward direction for a second set period of time so that the liquid detergent left in the first and second flow passages 58, 60, 62, and 64, the valve, and the detergent supply pump 66 can be recovered into the liquid detergent storage part. And, if the cleaning solution supply passage 56 is connected to the second flow passage 64, the detergent supply pump 66 re-operates in a forward direction for a third set period of time so that the inside of the second flow passage 64, the valve 52, and the detergent supply pump 66 can be cleaned with a cleaning solution. The above-described method of supplying a liquid detergent and removing a residual detergent is only an example, and the scope of this invention is not limited by the above method.

The operation of the washing machine 1 according to the first embodiment of the present invention thus-constructed will be described with respect to the execution of the stroke of the washing machine. Hereinafter, the supply of detergent by the detergent supply mechanism 18 will be omitted, and the description will be made with respect to a vase where a liquid detergent is supplied by the liquid detergent supply mechanism 50.

First, laundry is put into a drum 10 via a laundry entrance 2*a*, and the laundry entrance 2*a* is enclosed with a door 2*b* and then the drum type washing machine 1 is operated. At this time, the drum type washing machine 1 senses the volume of the laundry put in the drum 10, and sets water level, supply amount of detergent, washing time, and so on.

Then, a water supply mechanism 16 is operated to supply water into a tub 8 until a set water level is reached. In other words, when the water supply valves 20 of the water supply mechanism 16 are opened, water is introduced from an external water source via the water supply valves 20, and the water is supplied into the tub 8 along a first water supply hose 22, a detergent supply mechanism 18, and a second water supply hose 24. Also, the liquid detergent supply mechanism 50 is operated to supply a liquid detergent into the tub 8 until a set supply amount is reached. That is, when a water supply pump 66 of the liquid detergent supply mechanism 50 is operated, the liquid detergent stored in liquid detergent storage parts 48 is pumped by the detergent supply pump 66, and the liquid detergent flows into the tub 8 along first flow passages 58, 60, and 62, a valve 52, the detergent supply pump 66, and a second flow passage 64. The liquid detergent may be a laundry detergent for washing laundry and a bleaching agent for bleaching laundry.

Once the supply of water and a liquid detergent into the tub 8 is finished, a driving mechanism 6 is operated to rotate the drum 10 for a set period of time. Thus, the laundry in the drum 10 is lifted upward and then dropped downward by the rotation of the drum 10 and the lifter 12, thereby performing washing.

Once the washing stroke for the laundry is finished, the operation of the driving mechanism 6 is stopped, and then a draining mechanism 30 is operated to drain out the water used for the washing in the tub 8. Next, the water supply mechanism 16 is operated to re-supply water until a set water level is reached, and the liquid detergent supply mechanism 50 is operated to supply a liquid detergent into the tub 8 until a set supply amount is reached. At this time, the liquid detergent may be a softener of a liquid phase for softening laundry. When the supply of water and a softener is finished, the driving mechanism 6 is operated to re-rotate the drum 10, thereby performing the rinsing of the laundry.

Once the rinsing stroke for the laundry is finished, the operation of the driving mechanism 6 is stopped, and then the draining mechanism 30 is operated to drain out the water used for the rinsing in the tub 8. Then, when the water is completely drained out of the tub 8, the driving mechanism 6 is operated to rotate the drum 10 at a high speed, and thereafter the operation of the drum type washing machine 1 is stopped. One the drum 10 is rotated at a high speed, the water contained in the laundry is discharged to the outside of the drum 10, and the water collected in the tub 8 is drained out by the draining mechanism 30.

Figure 6:
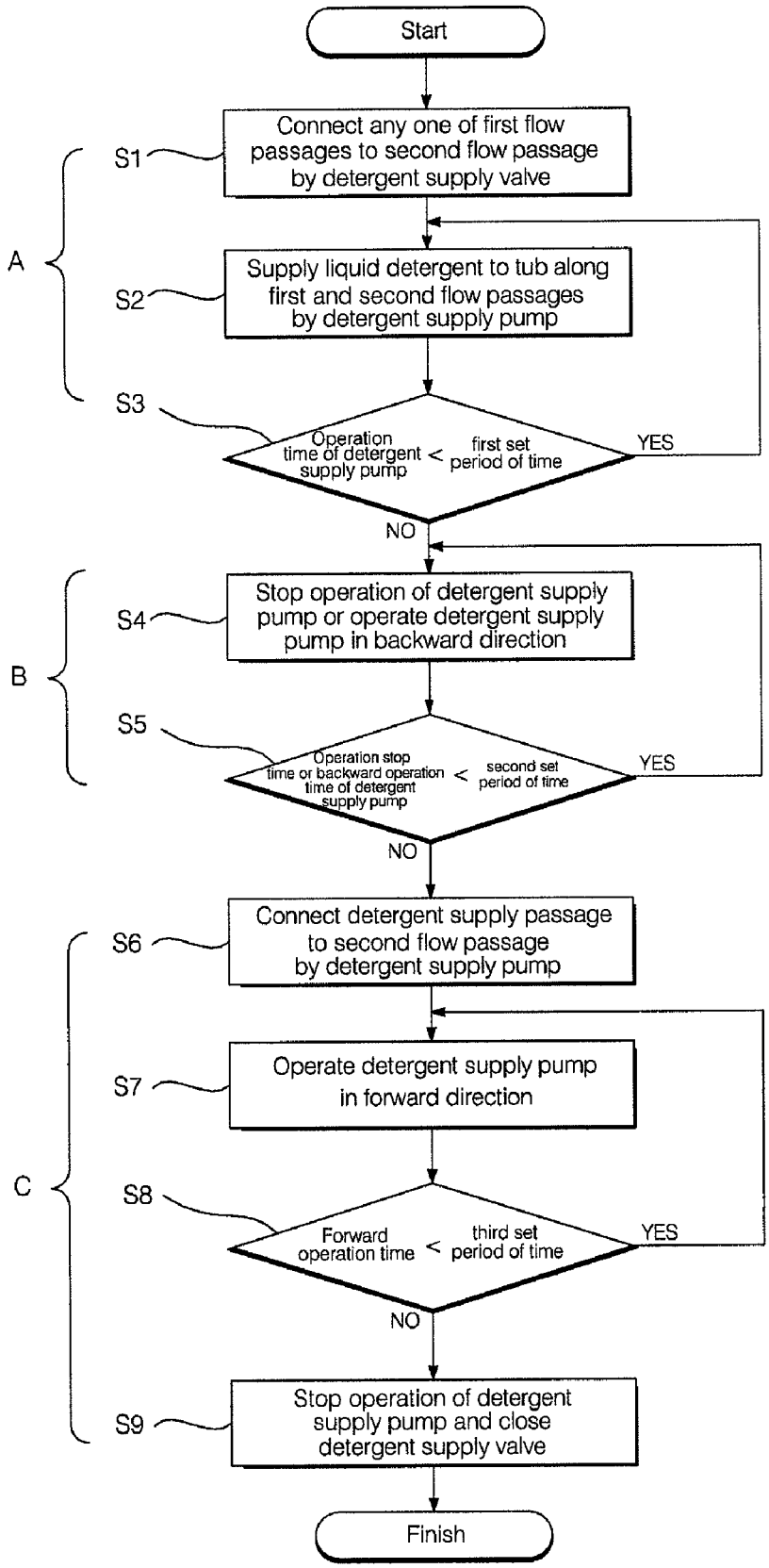
FIG. 6 is a sequential view showing a washing method of a drum type washing machine according to the first embodiment of the present invention.

FIG. 6 is a sequential view illustrating an example of a method for supplying a liquid detergent among available washing methods of the washing machine 1 according to the first embodiment of the present invention. Referring to FIGS. 3 and 6, the method for supplying a liquid detergent for the washing machine 1 will be described. The method for supplying a liquid detergent comprises a liquid detergent supply step A in which the liquid detergent supply mechanism 50 supplies a liquid detergent into the tub 8 from the liquid detergent storage parts 48, a liquid detergent recovery step B in which the liquid detergent left in the liquid detergent supply mechanism 50 is recovered to the liquid detergent storage parts 48 upon completion of the liquid detergent supply step A, and a liquid detergent washout step C in which a cleaning solution is supplied into the liquid detergent supply mechanism 50 to clean at least part of the inner flow passages of the liquid detergent supply mechanism 50.

In the liquid detergent supply step A, the valve 52 is operated to make any one of the first flow passages 58, 60, and 62 corresponding to the plurality of liquid detergent storage parts 48 communicated to the second flow passage 64, and the detergent supply pump 66 is operated in a forward direction to supply a set amount of liquid detergent to the tub 8 along the first and second flow passages 58, 60, 62, and 64 (S1, S2, and S3). In FIG. 3, the flow of liquid detergent supply in the liquid detergent supply step A is shown in arrow A.

This will be explained more concretely. In the washing stroke of the drum type washing machine 1, the valve 52 makes the first flow passages 58, 60, and 62 connected to the first liquid detergent storage part 48*a* communicated to the second flow passage 64, and then the detergent supply pump 66 supplies a laundry detergent in the first liquid detergent storage part 48*a* into the tub 8 until a set amount is reached. And, in the washing stroke of the drum type washing machine 1, the valve 52 makes the first flow passages 58, 60, and 62 connected to the second liquid detergent storage part 48*b* communicated to the second flow passage 64, and then the detergent supply pump 66 supplies a bleaching detergent in the second liquid detergent storage part 48*b* into the tub 8 until a set amount is reached. Also, in the rinsing stroke of the drum type washing machine 1, the valve 52 makes the first flow passages 58, 60, and 62 connected to the third liquid detergent storage part 48*c* communicated to the second flow passage 64, and then the detergent supply pump 66 supplies a softener in the third liquid detergent storage part 48*c* into the tub 8 until a set amount is reached.

The supply amount of liquid detergent of the detergent supply pump 66 is measured indirectly by the operation time of the detergent supply pump 66. Thus, if the operation time of the detergent supply pump 66 is more than a first set period of time, the operation of the detergent supply pump 66 is stopped. The first set period of time is set according to the volume of laundry, a laundry course, and the type of liquid detergent. Of course, as a method for measuring the supply amount of liquid detergent, a water level sensor or a weight sensor may be installed at the liquid detergent storage parts 48 to directly measure the supply amount of liquid detergent mechanistically.

In the liquid detergent recovery step B, the supply amount of liquid detergent in the liquid detergent supply step A reaches a set amount, the operation of the liquid detergent supply pump 66 is stopped for a second set period of time, or the detergent supply pump 66 is operated in a backward direction for a second set period of time (S4 and S5). In FIG. 3, the flow of liquid detergent recovery in the liquid detergent recovery step B is shown in arrow B.

When the detergent supply pump 66 is stopped for a second set period of time, the liquid detergent left in the first and second flow passages 58, 60, 62, and 64, the valve 52, and the detergent supply pump 66 flows downward by gravity along the second flow passage 64, the detergent supply pump 66, the valve 52, and the first flow passages 58, 60, and 62. Thus, the liquid detergent is recovered into the liquid detergent storage parts 48 disposed at a position lower than the first and second flow passages 58, 60, 62, and 64, the valve 52, and the detergent supply pump 66. However, the above-described liquid detergent recovery method is only implemented in a structure in which the tub 8, the second flow passage 64, the detergent supply pump 66, the valve 52, the first flow passages 58, 60, and 62, and the liquid detergent storage parts 48 are sequentially disposed in an up-down relation to each other.

On the other hand, when the detergent supply pump 66 is operated in a backward direction for a second set period of time, the liquid detergent left in the first and second flow passages 58, 60, 62, and 64, the valve 52, and the detergent supply pump 66 is forcedly recovered to the inside of the liquid detergent storage parts 48 by a pressure differential formed by the operation of the detergent supply pump 66. Accordingly, the above liquid detergent recovery method is not dependent upon the relative positions of the tub 8, the second flow passage 64, the detergent supply pump 66, the valve 52, the first flow passages 58, 60, and 62, and the liquid detergent storage parts 48, thereby making easier the design and manufacture of the washing machine 1.

In the liquid detergent washout step C, the valve 52 is operated to make the cleaning solution supply passage 56 corresponding to the cleaning solution storage part 54 communicated to the second flow passage 64, and the detergent supply pump 66 is re-operated in a forward direction, thus washing out the liquid detergent left on the flow passages as the cleaning solution flows along the cleaning solution supply passage 56, the valve 52, the second flow passage 64, and the detergent supply pump 66 (S6, S7, and S8). In FIG. 3, the flow of a cleaning solution supply in the liquid detergent washout step C is shown in arrow B.

That is to say, the valve 532 makes the cleaning solution supply passage 56 connected to the cleaning solution storage part 54 communicated to the second flow passage 64, and the detergent supply pump 66 supplies the cleaning solution in the cleaning solution storage part 54 into the tub 8 for a third set period of time. Thus, the cleaning solution in the cleaning solution storage part 54 flows into the tub 8 along the cleaning solution supply passage 56, the valve 52, the second flow passage 64, and the detergent supply pump 66, and the liquid detergent left in the vale 52, the second flow passage 64, and the detergent supply pump 66 is washed out with the cleaning solution.

Once the liquid detergent washout step C is finished, the operation of the detergent supply pump 66 is stopped, and the valve 52 is closed. The, the drum type washing machine 1 performs the next stroke (S9).

Hereinafter, a washing machine according to a second embodiment of the present invention will be described.

Figure 7:
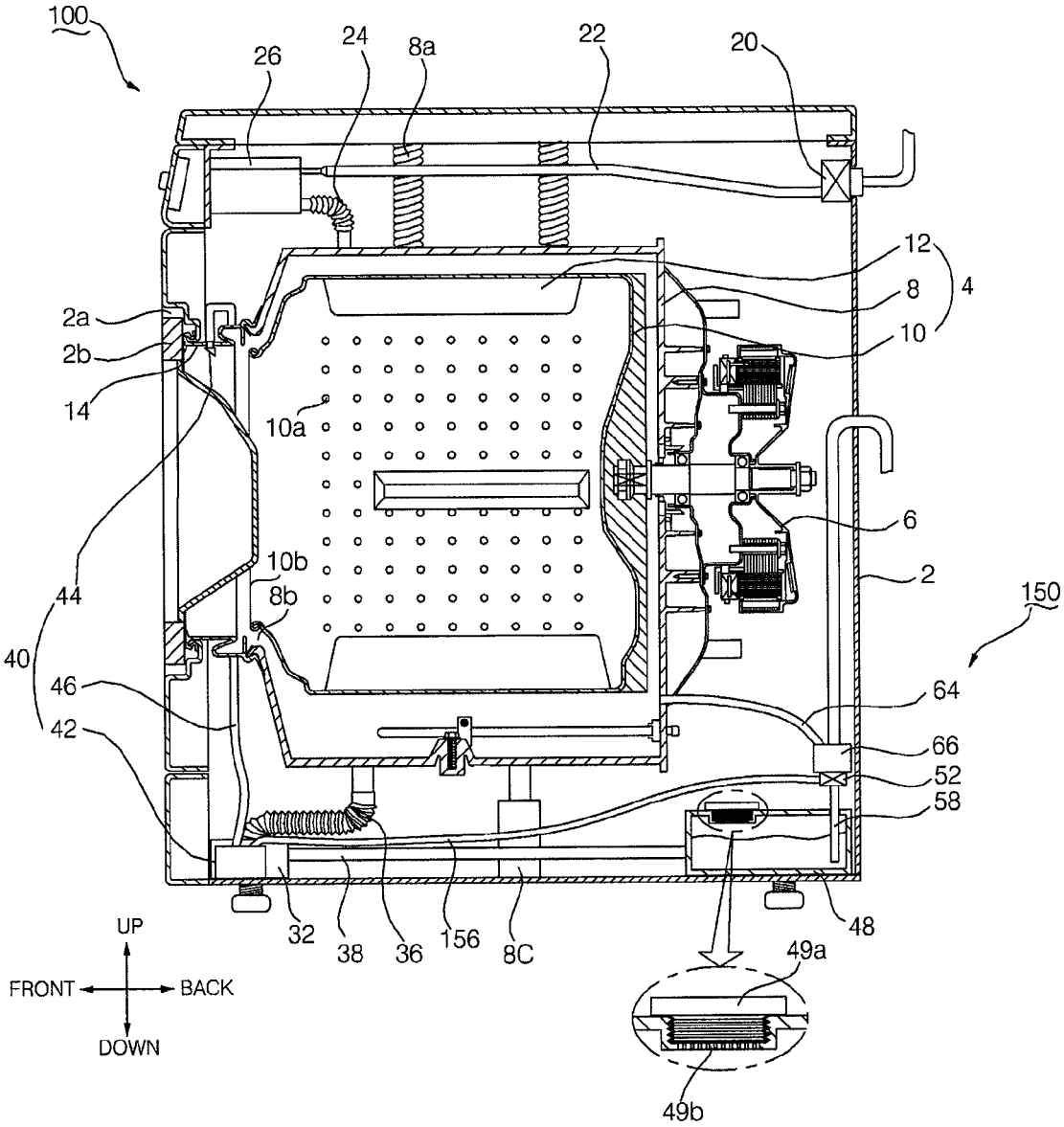
FIG. 7 is a side view showing a drum type washing machine according to a second embodiment of the present invention.
Figure 8:
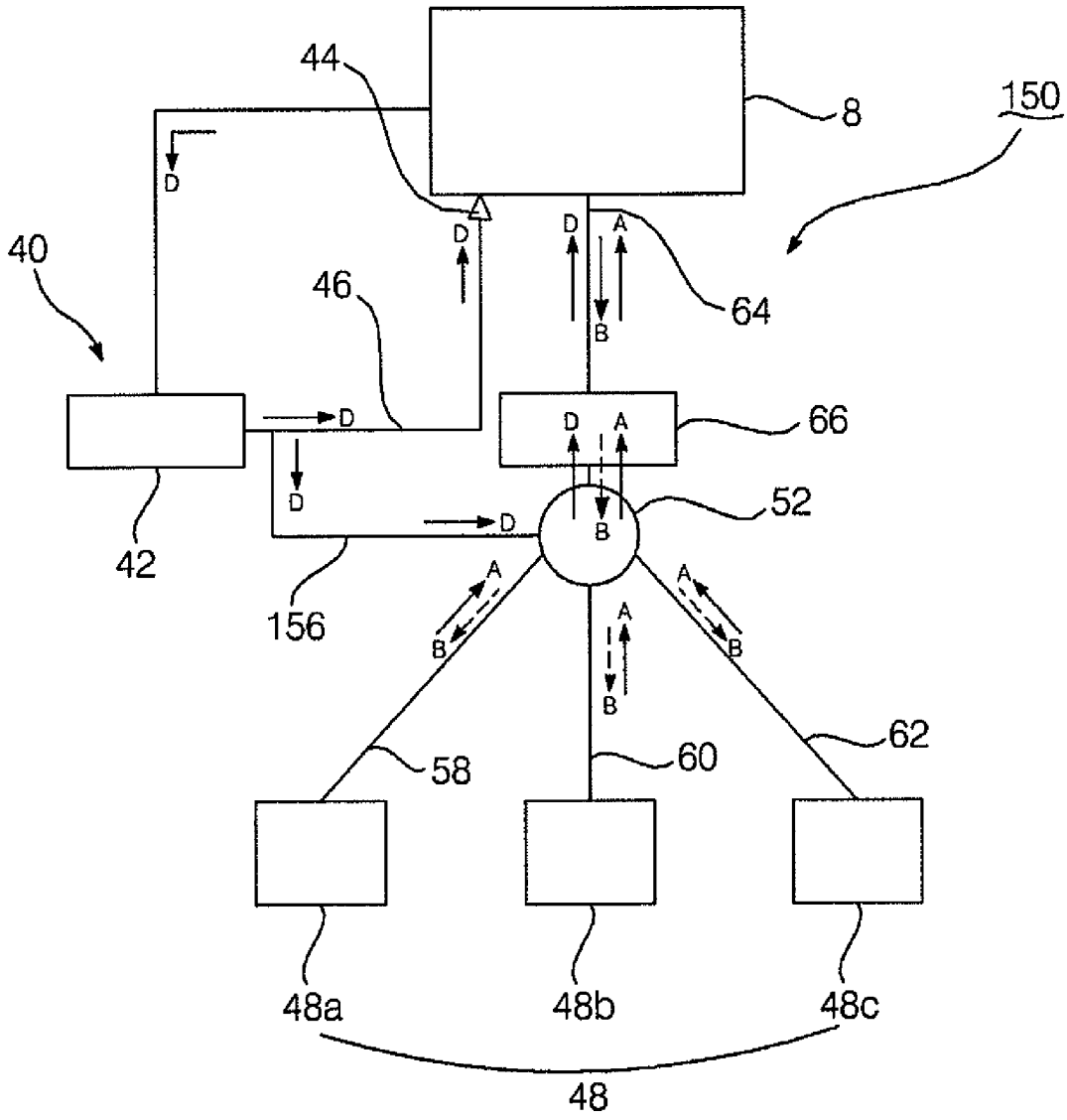
FIG. 8 is a block diagram schematically showing one example of essential parts of the drum type washing machine as shown in FIG. 7.
Figure 9:
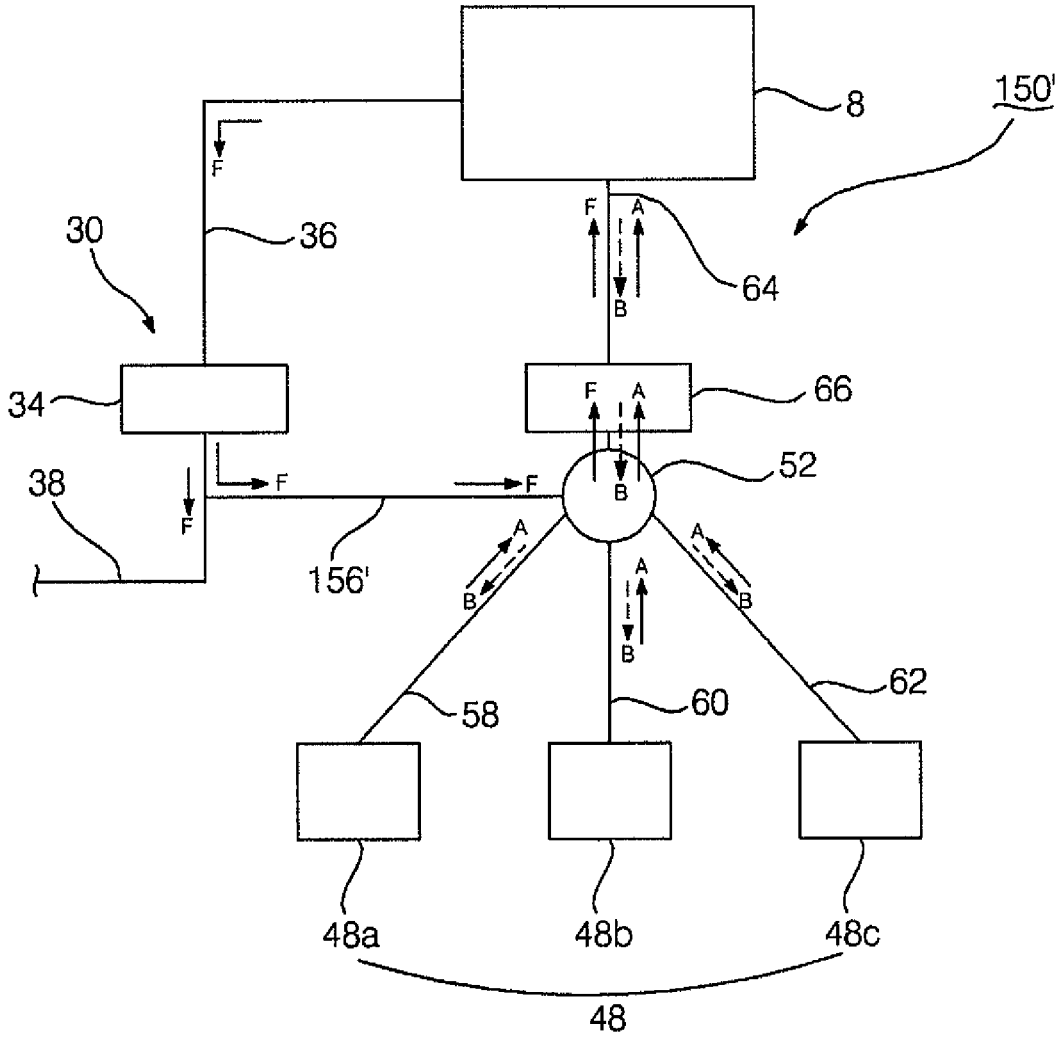
FIG. 9 is a block diagram schematically showing another example of essential parts of the drum type washing machine as shown in FIG. 7.

FIG. 7 is a side view showing a drum type washing machine according to a second embodiment of the present invention. FIG. 8 is a block diagram schematically showing one example of essential parts of the drum type washing machine as shown in FIG. 7. FIG. 9 is a block diagram schematically showing another example of essential parts of the drum type washing machine as shown in FIG. 7. In FIGS. 7 to 9, the same reference numerals as those of the drum type washing machine as shown in FIGS. 1 to 3 represent the same reference members. Hereinafter, the description will be made with respect to differences with the washing machine as shown in FIGS. 1 to 3. One important difference between the washing machine 100 according to the second embodiment of the present invention and the washing machine 1 according to the first embodiment of the present invention is that the cleaning solution storage part 54 for storing a cleaning solution is omitted, and the valve 52 and the circulation mechanism 40 are communicatively connected by a cleaning solution supply passage 156 of a liquid detergent supply mechanism 150. This will be hereinafter explained concretely.

One end of the cleaning solution supply passage 156 is communicatively connected to the valve 52, and the other end thereof is communicatively connected to the circulation mechanism 40. Thus, in this embodiment, the water in the tub 8 is used as a cleaning solution for cleaning the inner flow passages of the liquid detergent supply mechanism 150. One end of the cleaning solution supply passage 156 is communicatively connected to the first inlet 70*a* of the valve 52. The other end of the cleaning solution supply passage 156 is communicatively connected to the circulation pump 42 of the circulation mechanism 40. However, the other end of the cleaning solution supply passage 156 may be communicatively connected to the circulation hose 46 of the circulation mechanism 40.

Another important difference between the washing machine 100 according to this embodiment of the present invention and the washing machine 1 according to the first embodiment of the present invention is the liquid detergent washout step C for washing out the liquid detergent left in the second flow passage 64, the valve 52, and the detergent supply pump 66. That is, in the liquid detergent washout step C, the valve 52 is operated to make the cleaning solution supply passage 156 communicated to the second flow passage 64, and then the cleaning solution removes the liquid detergent left in the second flow passage 64, the valve 52, and the detergent supply pump 66 by a pressure differential induced by the circulation pump 42. Also, the detergent supply pump 66 may be operated together to form a pressure differential in order to remove the liquid detergent. Moreover, the water stored in the tub 8 washes out the liquid detergent left on the flow passages while flowing along the cleaning solution supply passage 156, the valve 52, the second flow passage 64, and the detergent supply pump 66 by the pressure differential formed by the circulation pump 42 or the detergent supply pump 66 operated together therewith. In FIG. 8, the flow of the cleaning solution in the liquid detergent washout step C is shown in arrow D.

Hereinafter, the liquid detergent washout step C applied in this embodiment will be described in details. First, the valve 52 makes the cleaning solution supply passage 156 communicated to the second flow passage 64. And, the circulation pump 42 is supplied with the washing water in the tub 8 by the first drainage hose 36, and pumps it to the circulation hose 46 and the cleaning solution supply passage 156. When a cleaning solution is introduced into the valve 52 via the cleaning solution supply passage 156, the detergent supply pump 66 supplies the cleaning solution introduced into the valve 52 into the tub 8 for a set period of time. Accordingly, the liquid detergent washout step C of this embodiment is carried out only at a water level at which the water in the tub 8 circulates by the circulation mechanism 40 in comparison with the liquid detergent washout step C of the one embodiment as show in FIG. 6. In other words, the liquid detergent supply step A and the liquid detergent recovery step B may be performed regardless of a water level in the tub 8, while whether the liquid detergent washout step C can be performed or not is determined according to a water level in the tub 8.

Hereinafter, a washing machine according to a third embodiment of the present invention will be described.

FIG. 9 illustrates the third embodiment of the washing machine 100 using the water in the tub 8 as a cleaning solution. In other words, in the washing machine 100, the valve 52 and the draining mechanism 30 are connected by a cleaning solution supply passage 156' of a liquid detergent supply mechanism 150'. That is, while the washing machine 100 as shown in FIGS. 7 and 8 uses the water being circulated by the circulation mechanism 40 as a cleaning solution, the washing machine 100 according to the third embodiment of the present invention uses the washing water being drained by the draining mechanism 30 as a cleaning solution. And, as the washing water drained according to a pressure differential formed by the drainage pump 34 is introduced into the washing tub 4 via the second flow passage 64, a residual detergent is removed. Also, in order to remove the residual detergent by the above-described method, one end of the cleaning solution supply passage 156' is communicatively connected to the first inlet 70*a* of the valve 52, and the other end of the cleaning solution supply passage 156' is connected to the drainage pump 34 of the drainage mechanism 30.

Hereinafter, the liquid detergent washout step C of the washing machine 100 of this embodiment will be described concretely. In the liquid detergent washout step C of the washing machine 100, the water in the tub 8 is supplied to the valve 52 by a pressure differential formed by the drainage pump 34. In a case where the detergent supply pump 66 is provided, an additional pressure differential may be formed by the detergent supply pump 66. In FIG. 9, the flow of the cleaning solution in the liquid detergent washout step C is shown in arrow E.

Meanwhile, in the washing machine of this embodiment, the liquid detergent washout step C is performed in the stroke in which the draining mechanism 30 operates. However, if the valve to be closed in the liquid detergent washout step C is separately disposed on the second drainage hose 38, the liquid detergent washout step C may be performed in all the strokes of the drum type washing machine 100.

Figure 10:
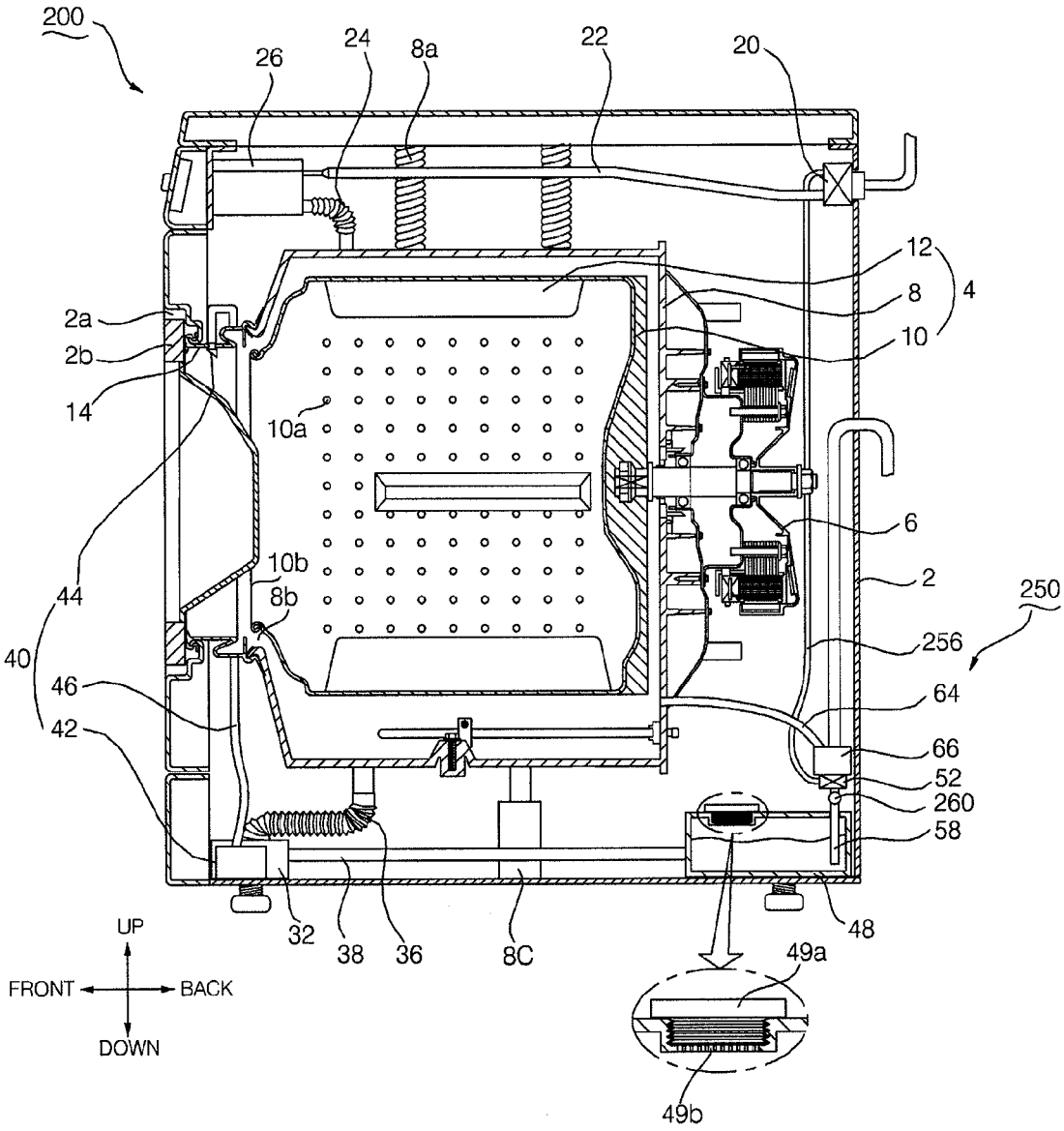
FIG. 10 is a side view showing a drum type washing machine according to a third embodiment of the present invention.
Figure 11:
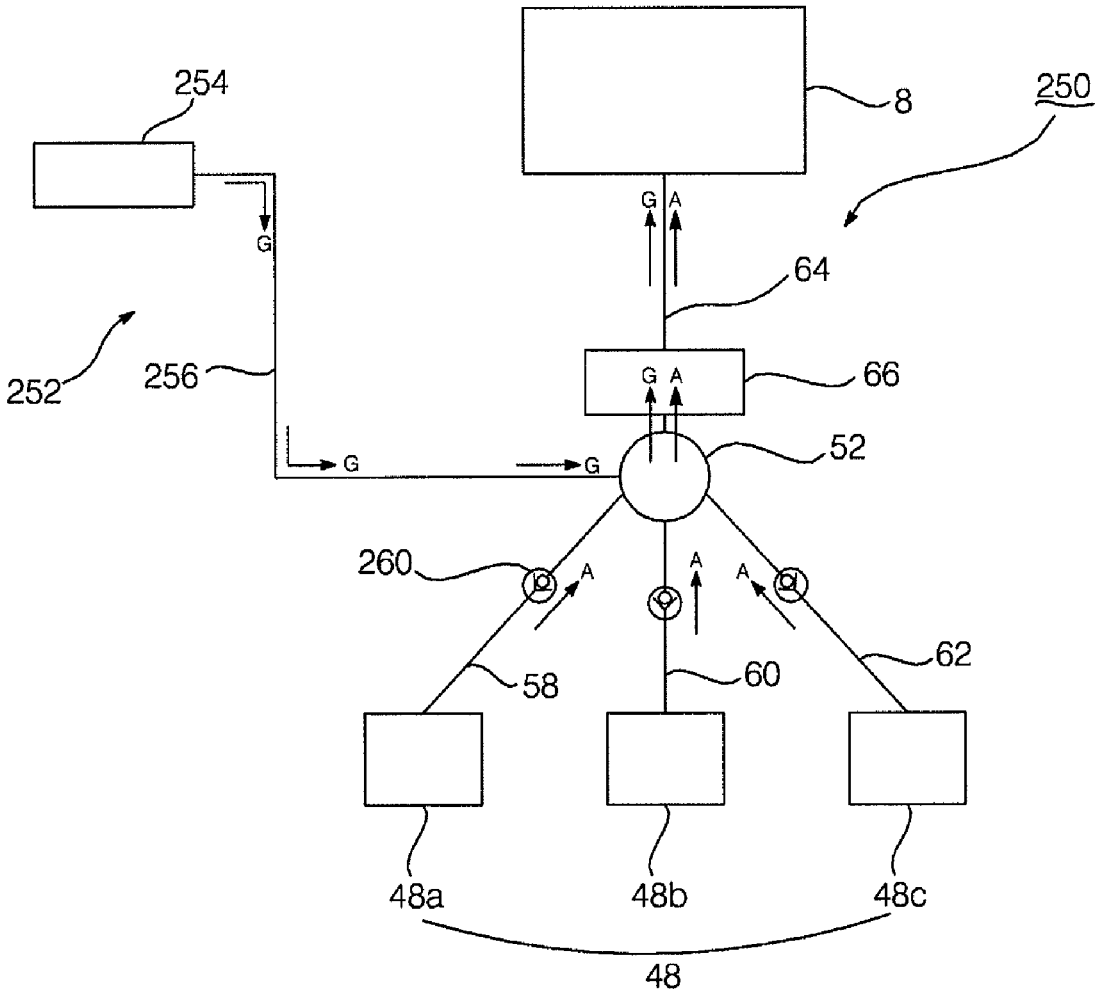
FIG. 11 is a block diagram schematically showing essential parts of a drum type washing machine according to a fourth embodiment of the present invention.

FIG. 10 is a side view showing a drum type washing machine according to a third embodiment of the present invention. In FIG. 10, the same reference numerals as those of the drum type washing machine as shown in FIGS. 1 to 3 represent the same reference members. Hereinafter, the description will be made with respect to differences with the washing machine as shown in FIGS. 1 to 3.

The washing machine 200 according to the third embodiment of the present invention as shown in FIG. 10 and the washing machine 1 according to the first embodiment of the present invention are different in that the cleaning solution storage part 54 for storing a cleaning solution is omitted, a cleaning solution supply part 252 for supply a cleaning solution is communicatively connected to the valve 52 of a liquid detergent supply mechanism 250, and check valves 260 are respectively disposed on the first flow passages 58, 60, and 62 connecting the liquid detergent storage parts 48 and the valve 52. Further, in the same embodiment, the cleaning solution is supplied to the valve 52 by a pressure (pressure of city water supplied by a city water supplier) of an external water source allowing a washing water to be supplied to the washing machine 200, thereby removing the liquid detergent left in the valve 52, the second flow passage 64, the detergent supply pump 66 and so on.

This will be described more concretely. The cleaning solution supply part 252 comprises a cleaning solution supply valve 254 communicatively connected to an external water source and a cleaning solution supply passage 256 connecting the cleaning solution supply valve 254 and the valve 52. Accordingly, in this embodiment, the water introduced via the cleaning solution supply valve 254 is used as a cleaning solution for cleaning the inner flow passages of the liquid detergent supply mechanism 250. The cleaning solution supply valve 254 may be disposed in the same configuration as that of the water supply valves 20 for supplying water into the tub 8. However, the cleaning solution supply part 252 may be formed in various configurations in different positions of the drum type washing machine 200.

One end of the cleaning solution supply passage 256 as above is communicatively connected to the valve 52, and the other end thereof is communicatively connected to the water supply valve 20. One end of the cleaning solution supply passage 256 may be communicatively connected to a hole formed at other regions than the first inlet hole 70*a* of the valve 52. This is because the liquid detergent supply mechanism 250 has a structure where the flow of a cleaning solution is controlled by the cleaning solution supply vale 254, and thus the valve 52 does not need to control the cleaning solution flowing through the cleaning solution supply passage 256 directly by itself.

Moreover, the check valves 260 are disposed respectively on the first flow passages 58, 60, and 62 corresponding to the liquid detergent storage parts 48. In the first flow passages 58, 60, and 62 as above, the check valves 260 make flows available only in a direction in which the liquid detergent flows by the valve 52. Accordingly, this prevents impurities from being introduced from outside via the first flow passages 58, 60, and 62, or prevents the phenomenon of backflow of the liquid detergent from the first flow passages 58, 60, and 62.

Meanwhile, the important difference between a washing method of a washing machine 200 according to a fourth embodiment of the present invention and the washing method of the washing machine 1 as shown in FIG. 6 is that the liquid detergent recovery step B of the liquid detergent supply method is omitted, and the liquid detergent left in the second flow passage 64, the valve 52, and the detergent supply pump 66 is washed out by the cleaning solution supply part 252 in the liquid detergent washout step C.

Although the liquid detergent is recovered to the liquid detergent storage parts 48 along the first flow passages 58, 60, and 62 in the liquid detergent recovery step B, the flow of the liquid detergent is prevented by the check valves 260, thus making impossible the implementation of the liquid detergent recovery step B.

In the liquid detergent washout step C, the valve 52 is operated to communicatively connect the cleaning solution supply passage 256 and the second flow passage 64, and then the cleaning solution valve 254 is operated to supply a cleaning solution into the valve 52 along the cleaning solution supply passage 256. Next, the detergent supply pump 66 is operated in a forward direction to wash out the liquid detergent left in the valve 52, the second flow passage 64, and the detergent supply pump 66. In FIG. 10, the flow of the cleaning solution in the liquid detergent washout step C is shown in arrow G.

The liquid detergent washout step C will be described in more details. The valve 52 makes the cleaning solution supply passage 256 communicated to the second flow passage 64, and the cleaning solution supply valve 254 is opened and operated to supply a cleaning solution to the cleaning solution supply passage 256 from an external water source. At this time, the cleaning solution flows along the cleaning solution supply passage 256, and then is introduced into the valve 52. The detergent supply pump 66 supplies the cleaning solution introduced into the valve 52 into the tub 8 for a set period of time. Accordingly, the cleaning solution flows along the cleaning solution supply valve 254, the cleaning solution supply passage 256, the valve 52, the second flow passage 64, and the detergent supply pump 66, thereby washing out the liquid detergent left in the valve 52, the second flow passage 64, and the detergent supply pump 66.

Although the washing machine according to the present invention has been described with reference to the illustrated drawings, it will be apparent to those skilled in the art that the present invention is not intended to be limited to the above-described embodiment and drawings, and various changes or modifications may be made therein without departing from the scope and the technical sprit of the present invention.

That is to say, the present invention is not limited to a drum type washing machine, but can be applied to a water jet washing machine or dishwashing machine into which a liquid detergent is to be put. Further, in the present invention, a specially made exclusive cleaner can be used. If the exclusive cleaner as above is used, a cleaning solution storage part for storing the exclusive cleaner is separately provided, and a separate filler port is formed at the cleaning solution storage part. Further, in the present invention, if the liquid detergent storage parts and the cleaning solution storage part are disposed on the upper side of the tub, the liquid detergent or cleaning solution is supplied to the tub by gravity. Thus, the detergent supply pump may be omitted.

What is claimed is:

1. A washing machine comprising:

a washing tub; and a liquid detergent supply mechanism, the liquid detergent supply mechanism comprising at least one liquid detergent storage container that stores liquid detergent to be supplied to the washing tub, wherein the liquid detergent supply mechanism is configured to supply the liquid detergent stored in the liquid detergent storage container to the washing tub, and to remove residual liquid detergent not supplied to the washing tub by using a cleaning solution, wherein the washing machine further comprises a draining mechanism that discharges the washing water stored in the washing tub, the cleaning solution includes the washing water drained by the draining mechanism, and the liquid detergent supply mechanism further comprises:

a valve;

a cleaning solution supply passage connecting the valve and the draining mechanism;

first flow passages connecting the valve and the at least one liquid detergent storage container; and a second flow passage selectively communicated with the first flow passages or the cleaning solution supply passage by the valve, for selectively guiding the liquid detergent or the cleaning solution to the washing tub.

2. The washing machine of claim 1, wherein the draining mechanism further comprises a drainage pump that generates a pressure differential to discharge the washing water being drained, and wherein, when the cleaning solution supply passage and the second flow passage are communicated with each other by the valve, the washing water being drained is fed to the washing tub via the second flow passage according to the pressure differential generated by the drainage pump.

3. The washing machine of claim 1, wherein the washing machine further comprises a detergent supply pump that generates a pressure differential for feeding the liquid detergent or the cleaning solution to the washing tub, wherein the operation of the detergent supply pump applies pressure to the cleaning solution to remove residual liquid detergent not supplied to the washing tub.

4. A washing machine comprising:

a washing tub; and a liquid detergent supply mechanism, the liquid detergent supply mechanism comprising at least one liquid detergent storage container that stores liquid detergent to be supplied to the washing tub, wherein the liquid detergent supply mechanism is configured to supply the liquid detergent stored in the liquid detergent storage container to the washing tub, and to remove residual liquid detergent not supplied to the washing tub by using a cleaning solution, wherein the washing machine further comprises a circulation mechanism that circulates washing water contained in the washing tub, the cleaning solution including the circulated washing water, and the liquid detergent supply mechanism further comprises:

a valve;

a cleaning solution supply passage connecting the valve and the circulation mechanism;

first flow passages connecting the valve and the at least one liquid detergent storage container; and a second flow passage selectively communicated with the first flow passages or the cleaning solution supply passage by the valve, for selectively guiding the liquid detergent or the cleaning solution to the washing tub.

5. A washing machine comprising a washing tub and a liquid detergent supply mechanism, the liquid detergent supply mechanism comprising:

at least one liquid detergent storage container that stores liquid detergent for supply to the washing tub;

a valve;

first flow passages connecting the valve and the liquid detergent storage container for guiding the liquid detergent stored in the liquid detergent storage container to the valve; and a cleaning solution supply passage for guiding cleaning solution to the valve, the cleaning solution removing residual liquid detergent not supplied to the washing tub, wherein the liquid detergent supply mechanism further comprises a second flow passage connecting the valve and the washing tub for selectively guiding the liquid detergent or the cleaning solution passing through the valve to the washing tub, and wherein the washing machine further comprises a detergent supply unit disposed on a water supply passage that supplies water to the washing tub, one end of the second flow passage being connected to the detergent supply unit.

6. The washing machine of claim 5, wherein check valves for preventing backflow of the liquid detergent are respectively disposed on the first flow passages.

7. The washing machine of claim 5, wherein the liquid detergent storage container includes plural containers, the number of the first flow passages corresponding to the number of liquid detergent storage containers, and the valve selectively communicating one of the first flow passages or the cleaning solution supply passage to the second flow passage.

8. The washing machine of claim 5, wherein the other end of the second flow passage is connected to the washing tub.

9. The washing machine of claim 5, wherein the liquid detergent supply mechanism further comprises a detergent supply pump disposed on the second flow passage to generate a pressure differential for supplying the liquid detergent to the washing tub.

10. The washing machine of claim 9, wherein the detergent supply pump operates in a forward direction for a first period of time to supply the liquid detergent in the liquid detergent storage container to the washing tub via the first flow passages, the valve, and the second flow passage, the detergent supply pump is stopped or operates in a backward direction for a second period of time to feed liquid detergent remaining in at least one of the first flow passages, the valve, and the second flow passage back to the liquid detergent storage container, and the detergent supply pump again operates in a forward direction for a third period of time to remove residual liquid detergent remaining in at least one of the first flow passages, the valve, and the second flow passage by feeding the cleaning solution to the washing tub.

11. A washing method of a washing machine having a washing tub and a liquid detergent supply mechanism, wherein the liquid detergent supply mechanism includes:

at least one liquid detergent storage container that stores liquid detergent for supply to the washing tub;

a valve;

first flow passages connecting the valve and the liquid detergent storage container for feeding the liquid detergent stored in the liquid detergent storage container to the valve;

a cleaning solution supply passage for guiding cleaning solution to the valve, the cleaning solution removing residual liquid detergent not supplied to the washing tub;

a second flow passage connecting the valve and the washing tub for selectively guiding the liquid detergent or the cleaning solution passing through the valve to the washing tub; and a detergent supply pump disposed on the second flow passage to generate a pressure differential for supplying the liquid detergent to the washing tub, the method comprising:

operating the detergent supply pump in a forward direction for a first period of time to supply the liquid detergent in the liquid detergent storage container to the washing tub via the first flow passages, the valve, and the second flow passage;

stopping or operating the detergent supply pump in a backward direction for a second period of time to feed the liquid detergent remaining in at least one of the first flow passages, the valve, and the second flow passage back to the liquid detergent storage container; and again operating the detergent supply pump in a forward direction for a third period of time to remove residual liquid detergent remaining in at least one of the first flow passages, the valve, and the second flow passage by feeding the cleaning solution to the washing tub.

* * * * *